US006695066B2

(12) United States Patent
Allamon et al.

(10) Patent No.: US 6,695,066 B2
(45) Date of Patent: Feb. 24, 2004

(54) SURGE PRESSURE REDUCTION APPARATUS WITH VOLUME COMPENSATION SUB AND METHOD FOR USE

(75) Inventors: Jerry P. Allamon, Montgomery, TX (US); Jack E. Miller, Houston, TX (US)

(73) Assignee: Allamon Interests, Montgomery, TX (US)

( * ) Notice: Subject to any disclaimer, the term of this patent is extended or adjusted under 35 U.S.C. 154(b) by 0 days.

(21) Appl. No.: 10/051,270

(22) Filed: Jan. 18, 2002

(65) Prior Publication Data

US 2003/0136563 A1 Jul. 24, 2003

(51) Int. Cl.[7] ..... E21B 33/13; E21B 34/14

(52) U.S. Cl. ..... 166/386; 166/383; 166/285; 166/332.4; 166/334.4; 166/319

(58) Field of Search ..... 166/383, 386, 166/332.4, 332.5, 334.4, 285, 318, 319, 323, 374; 138/30, 31

(56) References Cited

U.S. PATENT DOCUMENTS

| | | | | | |
|---|---|---|---|---|---|
| 3,730,267 | A | * | 5/1973 | Scott | 166/335 |
| 4,333,542 | A | * | 6/1982 | Taylor | 175/299 |
| 4,848,463 | A | * | 7/1989 | Ringgenberg et al. | 166/250.07 |
| 5,462,121 | A | * | 10/1995 | Schmuck et al. | 166/383 |
| 5,507,349 | A | * | 4/1996 | Wray et al. | 166/382 |
| 5,960,881 | A | * | 10/1999 | Allamon et al. | 166/291 |
| 6,182,766 | B1 | * | 2/2001 | Rogers et al. | 166/386 |
| 6,467,546 | B2 | * | 10/2002 | Allamon et al. | 166/381 |
| 6,491,103 | B2 | * | 12/2002 | Allamon et al. | 166/318 |
| 2002/0189814 | A1 | * | 12/2002 | Freiheit et al. | 166/373 |

* cited by examiner

*Primary Examiner*—David Bagnell
*Assistant Examiner*—T. Shane Bomer
(74) *Attorney, Agent, or Firm*—O'Neil & McConnell, PLLC; R. Perry McConnell

(57) ABSTRACT

A device for providing surge pressure reduction with volume compensation and methods of use are presented. Surge pressure reduction and volume compensation are accomplished by pressure-actuated release of the compensation device.

35 Claims, 10 Drawing Sheets

SURGE PRESSURE REDUCTION APPARATUS WITH VOLUME COMPENSATION SUB AND METHOD FOR USE

BACKGROUND OF THE INVENTION

1. Field of the Invention

The present invention relates to a method and apparatus for providing surge pressure reduction functionality while running a drilling/production liner or sub-sea casing down a borehole.

2. Description of the Prior Art

The principle of operation of a surge pressure reduction tool is described in U.S. Pat. No. 5,960,881 ("the '881 patent"), which is incorporated herein by reference and which should be referred to with respect to the advantages provided by that invention.

The invention of the '881 patent has provided the oil well industry with the long-desired capability of running in a drilling/production liner or sub-sea casing faster and more reliably with a minimum of lost drilling fluid. Particularly, the surge pressure reduction tool comprises a housing assembly connected between a drill pipe and a drilling/production liner. The housing assembly includes a set of flow holes and an axial bore formed therein. A sliding sleeve resides within the axial bore of the housing assembly. When the sliding sleeve is positioned above the set of housing flow holes such that the sleeve does not block the flow holes, communication is established between the axial bore of the tool and the annulus between the tool and the borehole. This is called the "open port position" and is established to facilitate surge pressure reduction when running a drilling/production liner through drilling fluid down a borehole. When the sliding sleeve is displaced axially downward such that the set of flow holes of the housing assembly is blocked, communication is interrupted between the axial bore of the tool and the annulus between the tool and the borehole. This is called the "closed port position" and is established to provide circulation of drilling fluid downward through the tool and to the bottom of the drilling/production liner without short-circuiting the flow of drilling fluid through the flow holes of the housing assembly. Additionally, the housing assembly contains a yieldable ball seat attached to the sliding sleeve to receive a drop ball to facilitate shifting the sliding sleeve axially downward from the open port position to the closed port position.

In operation, a drilling/production liner is run down a borehole using a drill pipe and a surge pressure reduction tool attached between the drill pipe and the drilling/production liner. Initially, the tool is set in the open port position to provide surge pressure reduction functionality while the tool is being lowered through drilling fluid down the borehole. As the drilling/production liner is lowered in the open port position, the drilling fluid flows upward through the drilling/production liner, into the tool, and outward into the annulus between the tool and the borehole via the flow holes. However, if the drilling/production liner encounters a tight hole or bridge condition within the borehole, then it is not possible to effectively circulate drilling fluid around the end of the drilling/production liner to help free it because the flow holes of the tool will short-circuit the flow of drilling fluid to the annulus outside the tool. Therefore, a drop ball is released into the drill pipe to land in the yieldable ball seat thereby effectively sealing the sliding sleeve. Drilling fluid pressure is then increased above the drop ball to shift the sliding sleeve axially downward into the closed port position. Drilling pressure is once again increased above the drop ball to push the ball through the yieldable ball seat and out of the bottom of the drilling/production liner. Drilling fluid can then be circulated from the drill pipe, past the surge pressure reduction tool, and through the drilling/production liner to free the drilling/production liner from the tight hole condition. Once the drilling/production liner is free, lowering of the drilling/production liner is continued until it reaches total depth.

At total depth, the surge pressure reduction tool must be in the closed port position to facilitate hanging and cementing operations. Therefore, if the drilling/production liner is run downhole without encountering a tight hole condition requiring the benefits of circulation, then the tool must be shifted to the closed port position once total depth is reached.

While the invention of the '881 patent provides the oil well industry with much desired surge pressure reduction functionality, it only provides a single sequence of surge pressure reduction functionality per trip downhole. Therefore, once the tool has been shifted to the closed port position to facilitate circulation of drilling fluid to free the drilling/production liner from a tight hole condition, the drilling/production liner must be lowered the remainder of the trip to total depth without the benefits of surge pressure reduction.

Accordingly, a multi-function surge pressure reduction tool may be used to provide an additional sequence of surge pressure reduction per trip downhole. The principle of operation of a multi-function surge pressure reduction tool is described in U.S. application Ser. No. 09/812,522 ("the '522 application"), which is incorporated herein by reference and which should be referred to with respect to the advantages provided by that invention. The multi-function surge pressure reduction tool in accordance with the '522 application includes a housing assembly with a set of flow holes formed therein and a valving sleeve with two sets of flow ports formed therein at different axial locations. When the set of flow holes of the housing assembly is aligned with either set of flow ports of the valving sleeve, the tool is in an open port position. When the set of flow holes of the housing assembly is not aligned with either set of flow ports of the valving sleeve, the tool is in a closed port position. Since the valving sleeve has two sets of flow ports, the tool can be shifted from a first open port position to a first closed port position, from the first closed port position to a second open port position, and from the second open port position to a second closed port position. Therefore, if the drilling/production liner being lowered downhole using the multi-function surge pressure reduction tool encounters a tight hole condition, the valving sleeve is shifted from the first open port position to the first closed port position. This permits circulation of drilling fluid to free the drilling/production liner from the tight hole condition. Then, the valving sleeve is shifted to the second open port position to provide surge pressure reduction functionality to the drilling/production liner for the remainder of the trip to total depth. Once the drilling/production liner reaches total depth, the valving sleeve is shifted downward to the second closed port position such that hanging and cementing operations may be commenced.

While the surge pressure reduction tool of the '881 patent and the multi-function surge pressure reduction tool of the '522 application provide a mechanism having surge pressure reduction functionality, it has been observed that circumstances may be encountered during the running downhole of a drilling/production liner where a tool in accordance with the '881 patent or the '522 application may be rendered ineffective to facilitate circulation and cementing operations. Particularly, if a drilling/production liner, while being lowered down the borehole, becomes plugged with drill cuttings and debris that were created and left in the borehole during drilling operations, then it may not be possible to shift the sliding sleeve downward into the closed port position. Therefore, with the sliding sleeve unable to shift out of the open port position, cementing operations can not be performed at total depth and circulation operations can not be performed if the drilling/production liner encounters a tight hole condition. This is due to a pressure build-up in the drilling fluid trapped between the yieldable ball seat sealed by the drop ball and the debris blocking the drilling/production liner. This pressure build-up causes a hydraulic lock condition in which the trapped drilling fluid resists the force exerted above the drop ball to shift the sliding sleeve axially downward. Therefore, the tool cannot be shifted out of the open port position and communication between the surface and the drilling/production liner via the drill pipe is short-circuited by the open flow ports of the tool.

Accordingly, the oil well industry would find desirable a surge pressure reduction tool that can be shifted to the open port position to provide surge pressure reduction and to the closed port position to facilitate cementing operations and circulation of drilling fluid even in the event that the drilling/production liner becomes plugged with drill cuttings or downhole debris.

SUMMARY OF THE INVENTION

In accordance with the present invention, a method and apparatus for reducing surge pressure while running a tubular member on a drill pipe with a running tool through drilling fluid down a borehole using a drilling rig is provided.

Apparatus in accordance with the present invention includes a diverter device having a housing assembly with a set of flow holes formed therein. The housing assembly is suspended from a drill pipe such that the drill pipe provides a communication conduit between the drilling rig on the surface and the borehole. The diverter device also includes a sliding sleeve positioned within the housing assembly. When the set of flow holes of the housing assembly is not blocked by the sleeve, the tool is in an "open port position." When the set of flow holes of the housing assembly is blocked by the sleeve, the tool is in a "closed port position."

Apparatus in accordance with the present invention also includes a volume compensation device connected between the drilling/production liner and the diverter device. The volume compensation device, when activated, accumulates a volume of drilling fluid which is equal to or greater than the volume of drilling fluid displaced when the sliding sleeve moves from the open port position to the closed position.

In a preferred embodiment, the volume compensation device includes a housing having an upper end and a lower end and an axial bore formed therethrough. Additionally, the housing includes a set of annulus flow ports formed therein near the upper end. The volume compensation device also includes an inner sleeve having an upper end and a lower end, and an outer diameter smaller than the diameter of the axial bore of the housing. The total length of the inner sleeve is less than the length of the axial bore of the housing. The inner sleeve is arranged within the axial bore of the housing, and the upper end of the inner sleeve is attached to the upper end of the housing to form an annulus between the inner sleeve and the housing. An annular piston having an inner diameter approximately equal to the outer diameter of the sleeve and an outer diameter approximately equal to the diameter of the axial bore of the housing is attached to the lower end of the sleeve by at least one shear pin. If the drilling/production liner becomes plugged with drill cuttings or downhole debris, then trapped drilling fluid pressure within the volume compensation plug applies an upward force against the annular piston such that the set of shear pins shear and the annular piston moves axially upward. This provides the apparatus of the present invention with additional volume as required to shift the diverter device to the closed port position.

Furthermore, in the closed port position, apparatus in accordance with the present invention provides a flow path for drilling fluid to flow downward from the drill pipe to the diverter device, from the diverter device to the volume compensation device, from the volume compensation device to the running tool, from the running tool to the tubular member, and from the tubular member out into the borehole. Providing this flow path facilitates circulation and cementing operations.

Still furthermore, in the open port position, apparatus in accordance with the present invention provides an alternative flow path for drilling fluid to flow upward from the borehole into the tubular member, from the tubular member to the running tool, from the running tool to the volume compensation device, from the volume compensation device to the diverter device, and from the diverter device out into an annulus between the drill pipe and the borehole via the set of housing flow holes. Providing this flow path facilitates surge pressure reduction when lowering the tubular member downhole through drilling fluid.

DESCRIPTION OF SPECIFIC EMBODIMENT

In oilfield applications, a "drilling/production liner" and a "sub-sea casing" are tubular members which are run on drill pipe. The term "sub-sea casing" is used with respect to offshore drilling operations, while the term "drilling/production liner" is used with respect to both land and offshore drilling operations. For ease of reference in this specification, the present invention is described with respect to a "drilling/production liner." In the appended claims, the term "tubular member" is intended to embrace either a "drilling/production liner" or a "sub-sea casing." Additionally, the term "operatively connected" is used to mean "in direct connection with" or "in connection with via another element."

A description of a preferred embodiment of the present invention is provided to facilitate an understanding of the invention. This description is intended to be illustrative and not limiting of the present invention.

Figure 1:
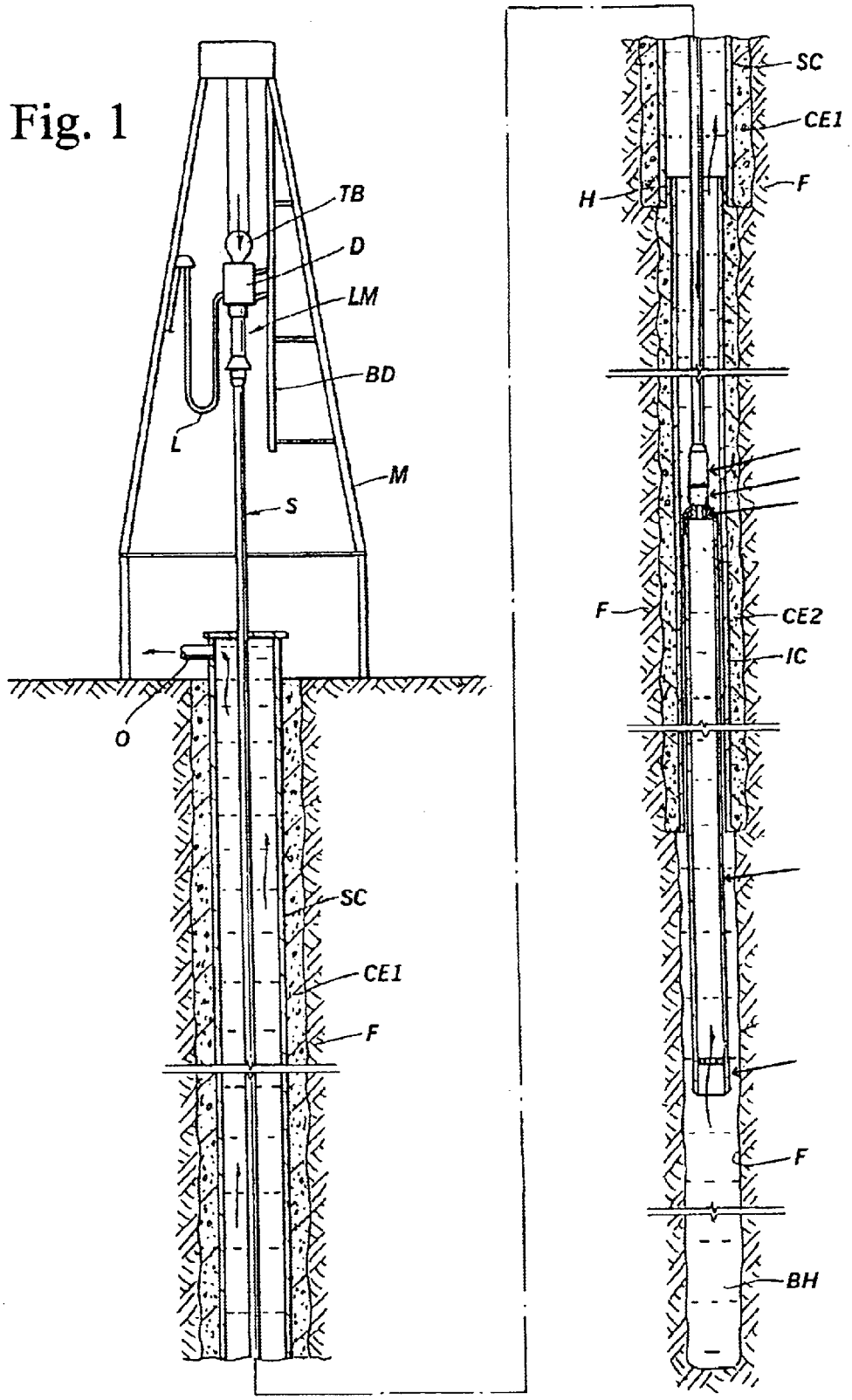
FIG. 1 is an elevation view of a wellbore depicting a drilling/production liner being run downhole on a drill pipe.

With reference first to FIG. 1, the general components of a system in which a tool in accordance with the present invention is used are illustrated. A mast M suspends a traveling block TB. The traveling block TB supports a top drive D which moves vertically on a block dolly BD. An influent drilling fluid line L supplies the top drive D with drilling fluid from a drilling fluid reservoir (not shown). A launching manifold LM connects to a drill string S. The drill string S comprises a plurality of drill pipe segments which extend down into a borehole BH, and the number of such pipes is dependent on the depth of the borehole BH. A diverter device 100 and volume compensation device 101 in accordance with the present invention are connected between the bottom end of drill string S and the top of running tool 102. The running tool 102 is preferably a casing hanger. A drilling/production liner 103 is suspended from the running tool 102. An open guide shoe 104 is fastened to the bottom of the drilling/production liner 103.

Still with reference to FIG. 1, solidified cement CE1 fixes a surface casing SC to surrounding formation F. The surface casing SC contains an opening O in the uppermost region of the casing adjacent to the top. The opening O controls return of drilling fluid as it travels up the annulus between the drill string S and the surface casing SC. Additionally, solidified cement CE2 fixes an intermediate casing IC to the surrounding formation F. The intermediate casing IC is hung from the downhole end of the surface casing SC by a mechanical or hydraulic hanger H.

Still further with reference to FIG. 1, a preferred embodiment of the present invention includes a diverter device 100 having an upper end an a lower end. The upper end of the diverter device 100 is operatively connected to the drill string S. The lower end of the diverter device 100 is operatively connected to a volume compensation device 101. The volume compensation device 101 is operatively connected to a drilling/production liner 103 via a running tool 102.

Figure 2:
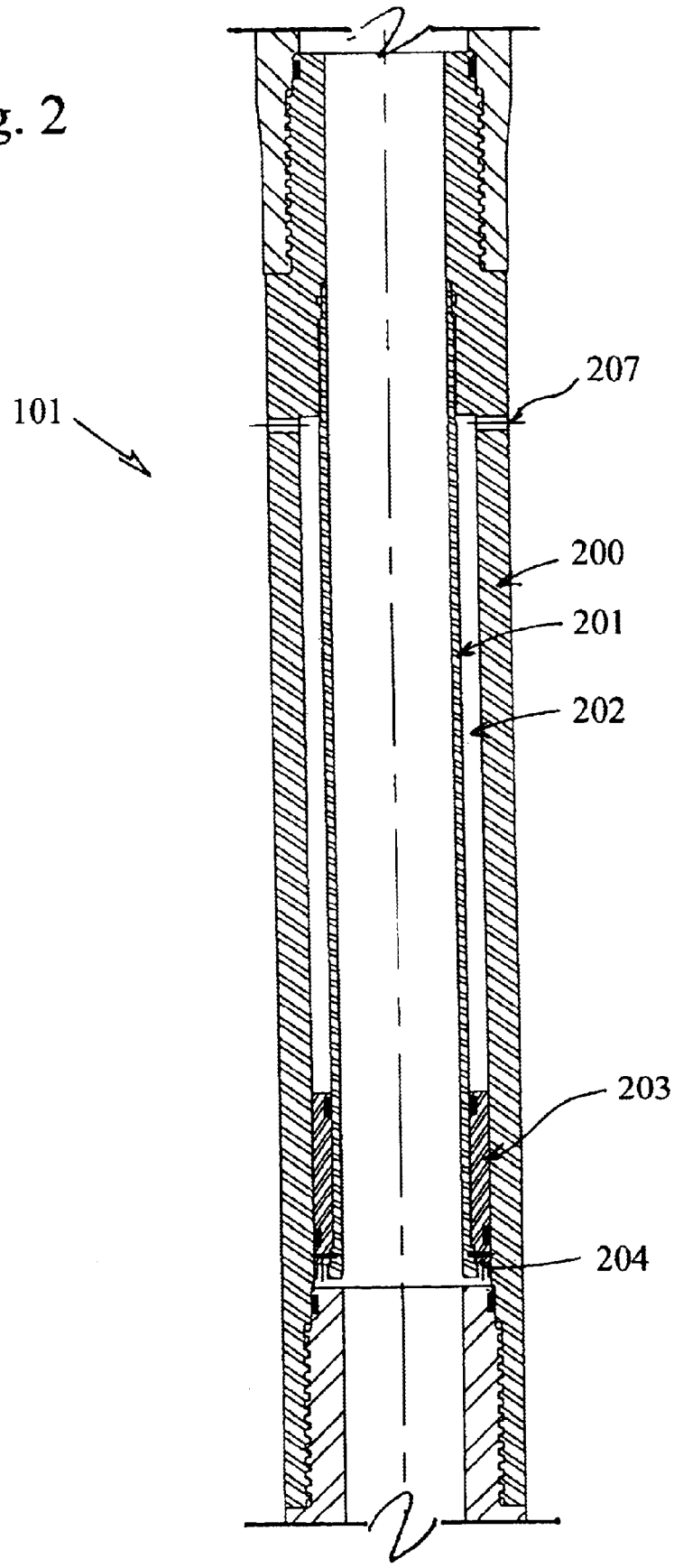
FIG. 2 is a sectional view of a volume compensation device in accordance with the present invention.
Figure 3:
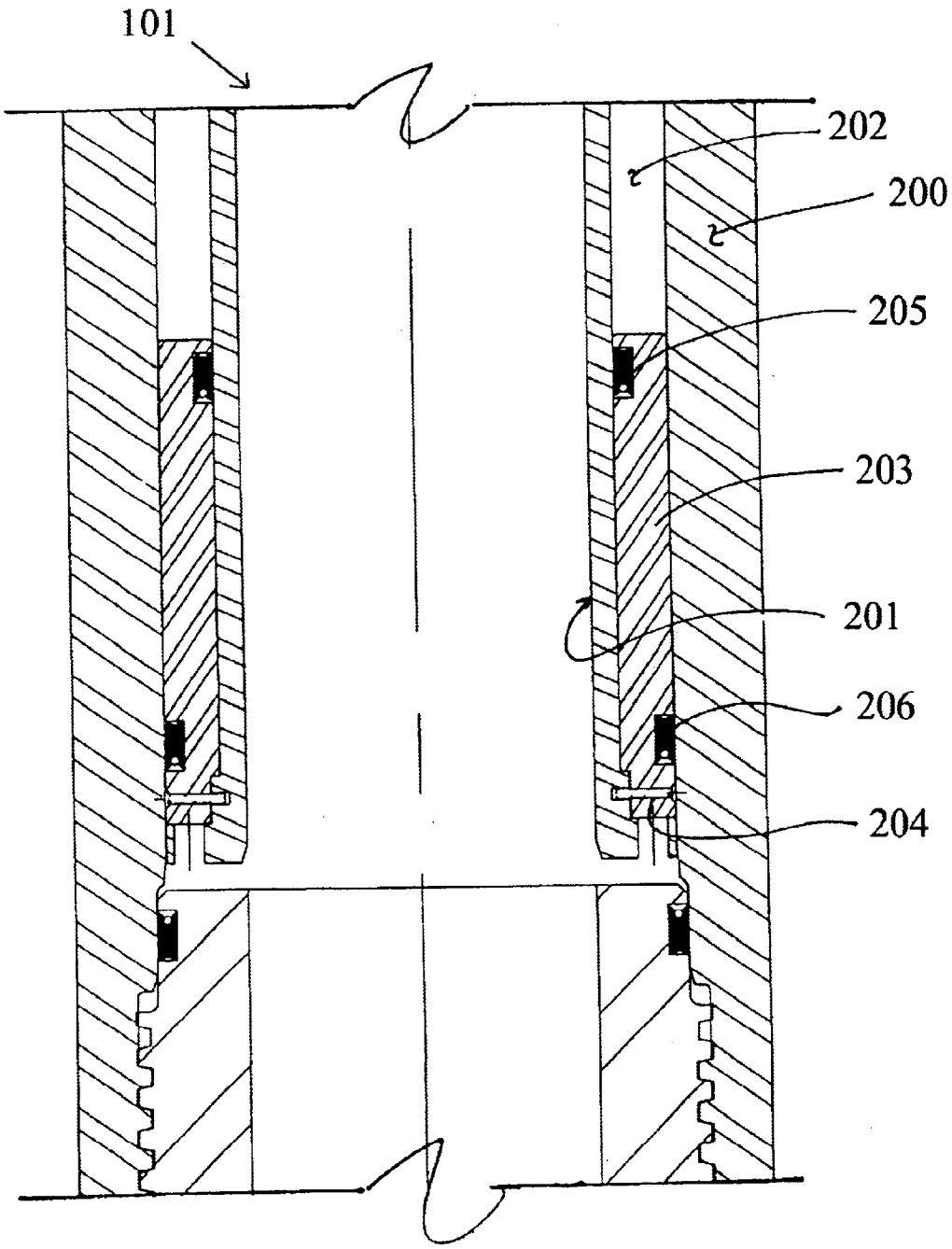
FIG. 3 is an enlarged view of the volume compensation device of FIG. 2.

With reference to FIGS. 2 and 3, a preferred embodiment of the volume compensation device 101 in accordance with the present invention includes a housing 200 having an upper end and a lower end and an axial bore formed therethrough. The volume compensation device 101 further includes an inner sleeve 201 with an upper end and a lower end and having an outer diameter smaller than the diameter of the axial bore of the housing 200. The total length of the inner sleeve 201 is less than the length of the inner bore of the housing 200. The inner sleeve 201 is arranged withing the housing 200 and the upper end of the sleeve is attached to the upper end of the housing to form a compensation volume annulus 202 between the inner sleeve and the housing. An annular piston 203 having an inner diameter approximately equal to the outer diameter of the inner sleeve 201 and an outer diameter approximately equal to the diameter of the axial bore of the housing 200 is attached to the lower end of the sleeve by a set of one or more shear pins 204. The annular piston 203 includes an inner seal 205 for sealing with the outer wall of the inner sleeve 201 and an outer seal 206 for sealing with the axial bore of the housing 200. The inner seal 205 and the outer seal 206 are preferably O-rings. The housing 200 also has at least one annulus hole 207 formed therein near the upper end to establish communication between the compensation volume annulus 202 and the borehole BH (FIG. 1).

Figure 4:
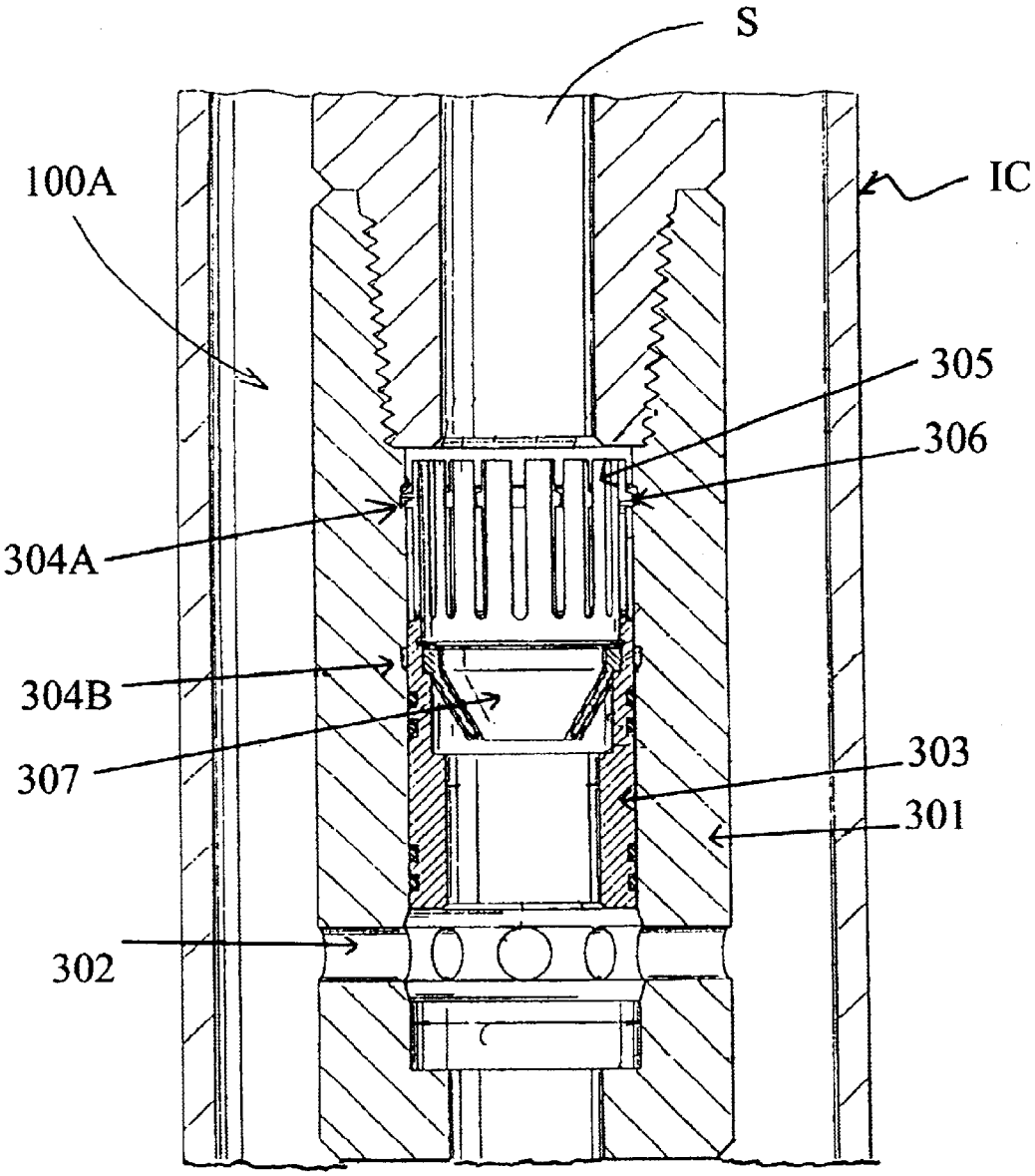
FIG. 4 is an elevation view of a first embodiment of a surge pressure reduction tool having a single sequence of surge pressure reduction functionality.

With reference to FIG. 4, a first embodiment of the present invention includes a diverter device 100A having a single sequence of surge pressure reduction functionality. The diverter device 100A comprises a housing assembly 301 having an upper end, a lower end, and an axial bore therethrough. The upper end of the housing assembly 301 is operatively connected to a drill string S. The lower end of the housing assembly 301 is operatively connected to a volume compensation device 101 (FIG. 2). The housing assembly 301 includes a set of flow holes 302 formed therein for establishing communication between the annulus outside the diverter device 100A and the axial bore. The axial bore of the housing assembly 301 includes an upper circumferential groove 304A and a lower circumferential groove 304B formed therein.

Figure 6:
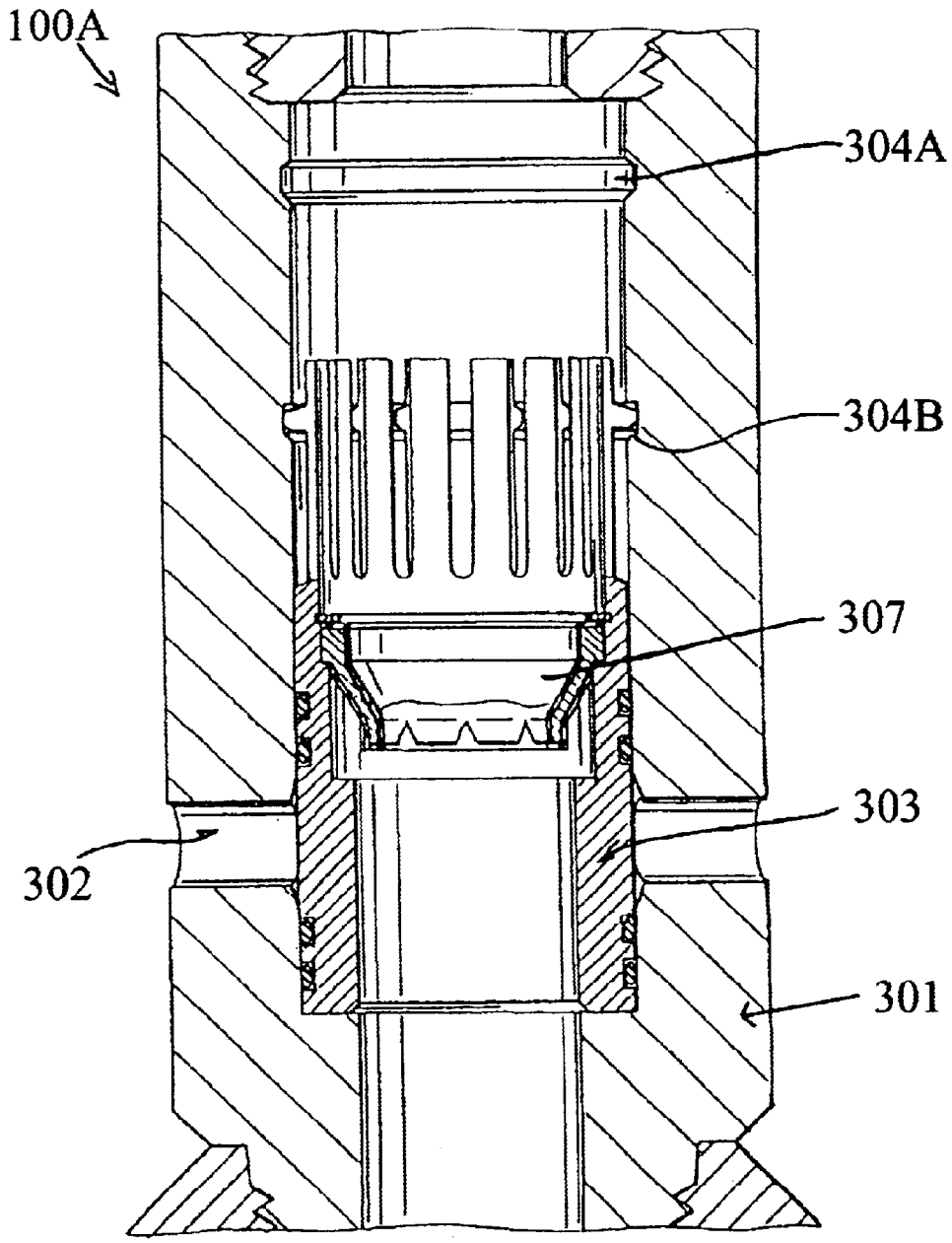
FIG. 6 is an elevation view of a first embodiment of a surge pressure reduction tool having a single sequence of surge pressure reduction functionality in the closed port position.

Still with reference to FIG. 4, a sleeve 303 having an upper end and a lower end is arranged within the axial bore of the housing 301. A plurality of latching fingers 305 are formed on the upper end of the sleeve 303. Each of the latching fingers 305 has a shoulder 306 formed on its end protruding radially outward for engagement with the circumferential grooves 304A and 304B of the housing assembly 301. When the shoulder 306 of each latching finger 305 engages the upper circumferential groove 304A such that the lower end of the sleeve 303 does not block the housing flow holes 302, the diverter device 100A is in an "open port position." In the open port position, communication is established between the axial bore of the housing assembly 301 and the annulus outside the housing assembly. When the shoulder 306 of each latching finger 305 engages the lower circumferential groove 304B and the lower end of the sleeve 303 blocks the housing flow holes 302, the diverter device 101A is in a "closed port position" (FIG. 6). In the closed port position, communication between the axial bore of the housing assembly 301 and the annulus outside the housing assembly is interrupted.

Figure 5:
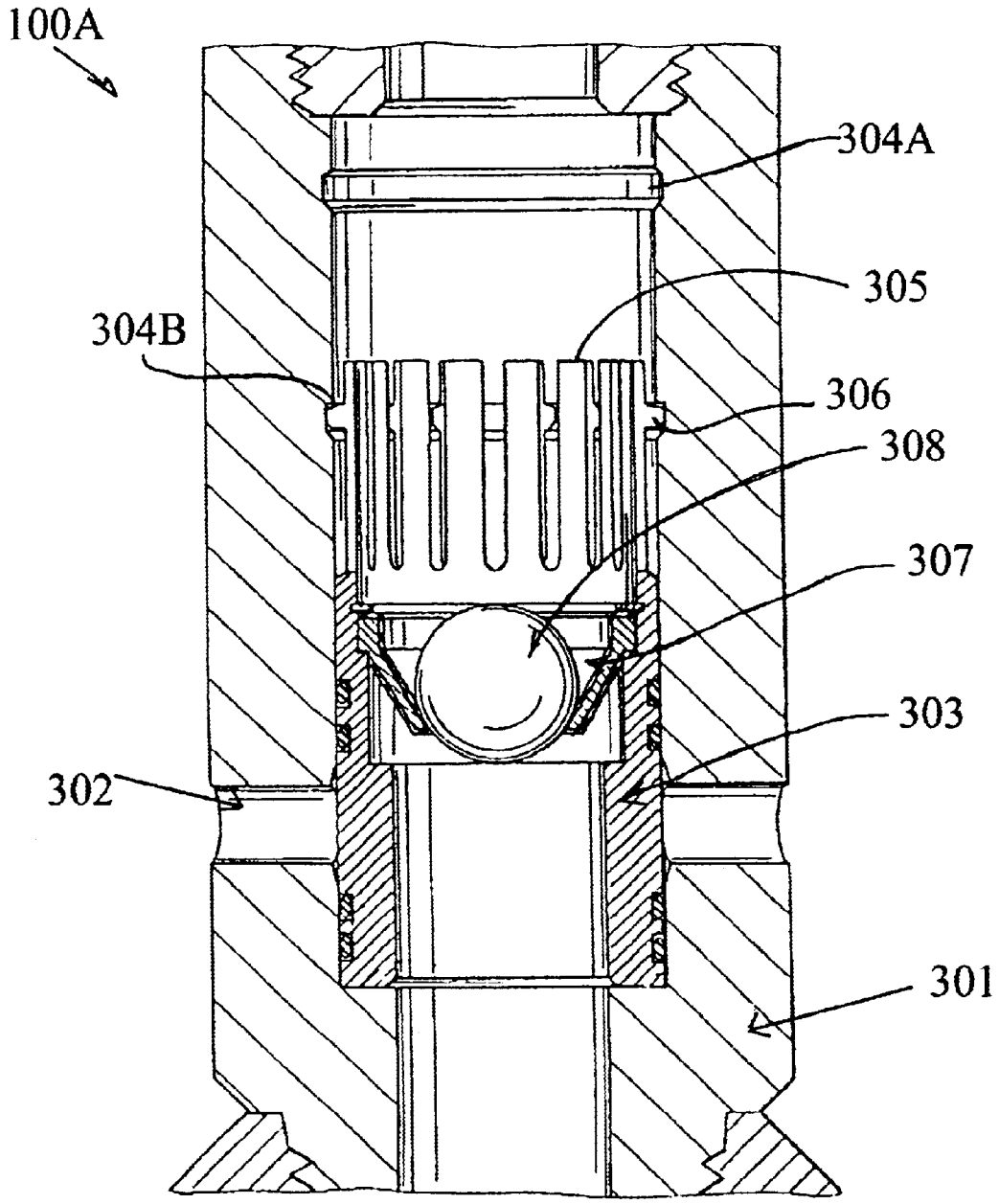
FIG. 5 is an elevation view of a first embodiment of a surge pressure reduction tool having a single sequence of surge pressure reduction functionality in the open port position.

With reference to FIGS. 4–6, the diverter device 100A further includes a yieldable ball seat 307 and a drop ball 308 for shifting the sleeve from the open port position to the closed port position.

With respect to FIGS. 1 and 4, in operation, the diverter device 100A is run into a borehole with the sleeve 303 positioned such that the shoulders 306 of the latching fingers 305 engage the upper circumferential groove 304A. In this "open port position," a flow path exists for drilling fluid to flow upward from the borehole BH into the drilling/production liner 103, through the volume compensation device 101 and diverter device 100A, and outward to the annulus between the drill string S and surface casing C2 via the set of housing flow holes 302.

The drilling/production liner 103 is run into the borehole with the diverter device 100A in the open port position and thus the benefits of surge pressure reduction are realized. However, if the drilling/production liner 103 encounters a tight hole condition within the borehole BH, then circulation is required to free the drilling/production liner, and the diverter device 100A must be moved to the closed port position.

With reference to FIG. 5, the diverter device 100A is shifted to the closed port position by releasing the drop ball 308 down the drill string S and into the yieldable ball seat 307. Drilling fluid pressure is then increased above the drop ball 308 and the yieldable ball seat 307 to a first predetermined level which forces the shoulders 306 of the latching fingers 305 radially inward. The inward radial motion of the shoulders 306 releases the latching fingers 305 and the sleeve 303 moves axially downward. The downward movement of the sleeve 303 is arrested when the shoulders 306 of the latching fingers 305 engage the lower circumferential groove 304B, and the diverter device 100A is now in the closed port position.

With reference to FIGS. 1 and 6, once in the closed port position, the drilling fluid pressure is increased to a predetermined level above the drop ball 308 to force the drop ball through the yieldable ball seat 307. In this "closed port position," a flow path exists for drilling fluid to flow downward from the drill string S, through the diverter device 100A and volume compensation sub 101, and outward into the borehole BH via the drilling/production liner 103.

Figure 7:
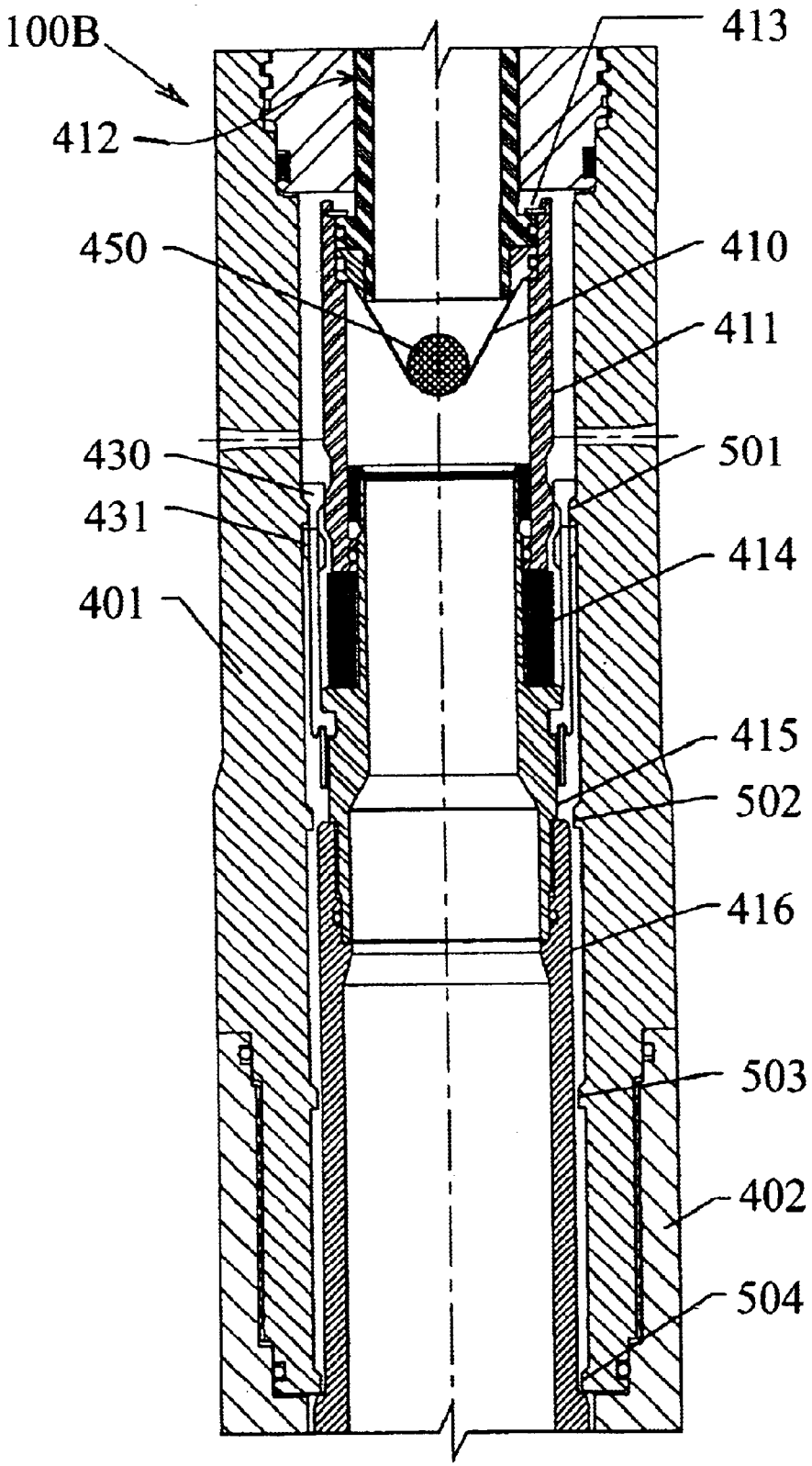
FIG. 7 is an enlarged view of an indexing apparatus of a second embodiment of a surge pressure reduction tool having multiple sequences of surge pressure reduction functionality in the open port position.
Figure 8:
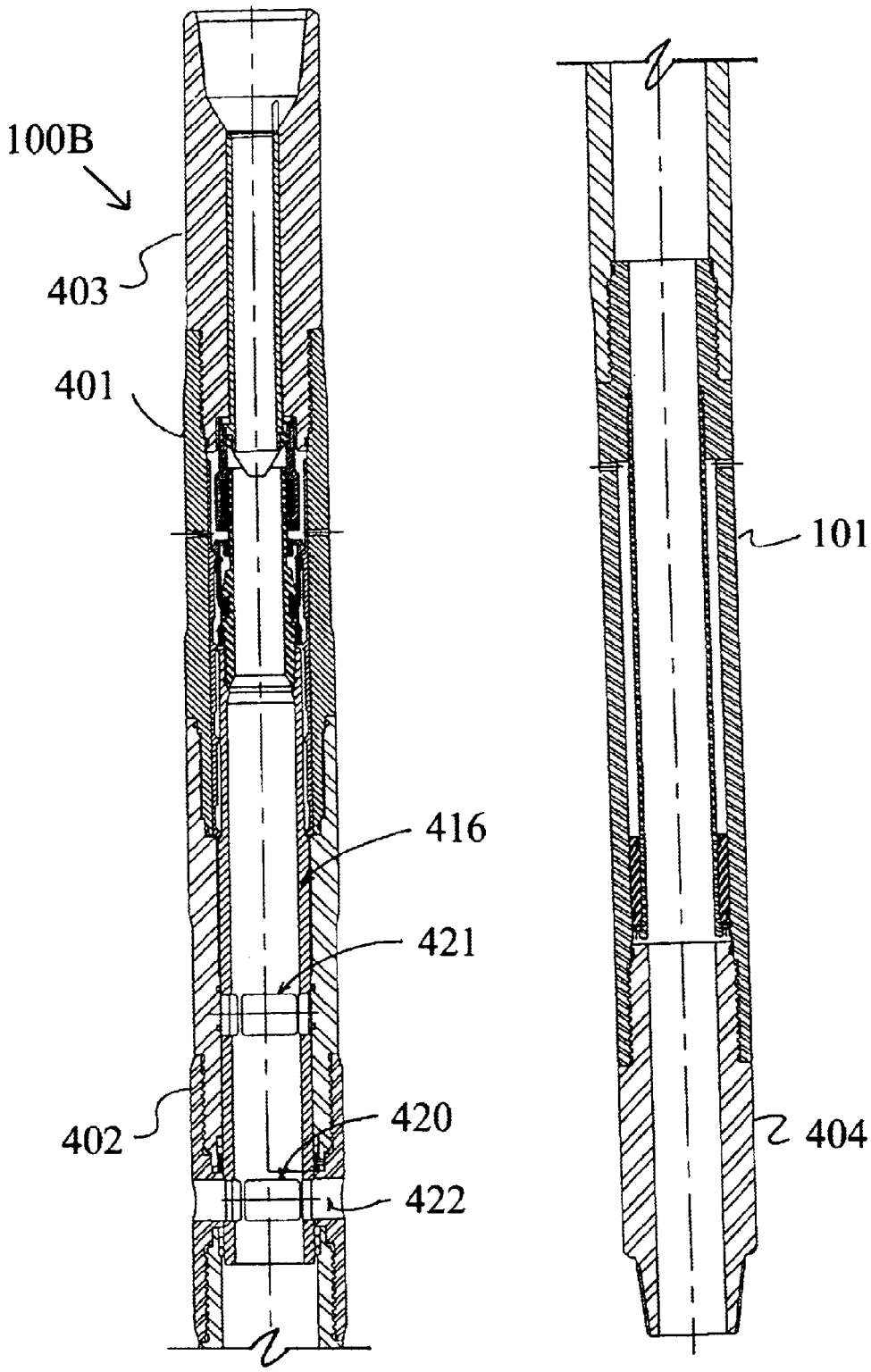
FIG. 8 is an elevation view of a second embodiment of a surge pressure reduction tool having multiple sequences of surge pressure reduction functionality in the open port position.

With reference to FIGS. 7 and 8, a second embodiment of the present invention includes a diverter device 100B having multiple sequences of surge pressure reduction functionality. The diverter device 100B comprises a housing assembly with an upper housing 401 and a lower housing 402 which are in threaded engagement with one another. The upper housing 401 is in threaded engagement with a top sub 403, and the lower housing 402 is in threaded engagement with a volume compensation device 101. The volume compensation device 101 is in threaded connection with a bottom sub 404. The top sub is operatively connected to the drill string S (FIG. 1). The bottom sub is operatively connected to the drilling/production liner 103 via running tool 102 (FIG. 1).

Figure 9:
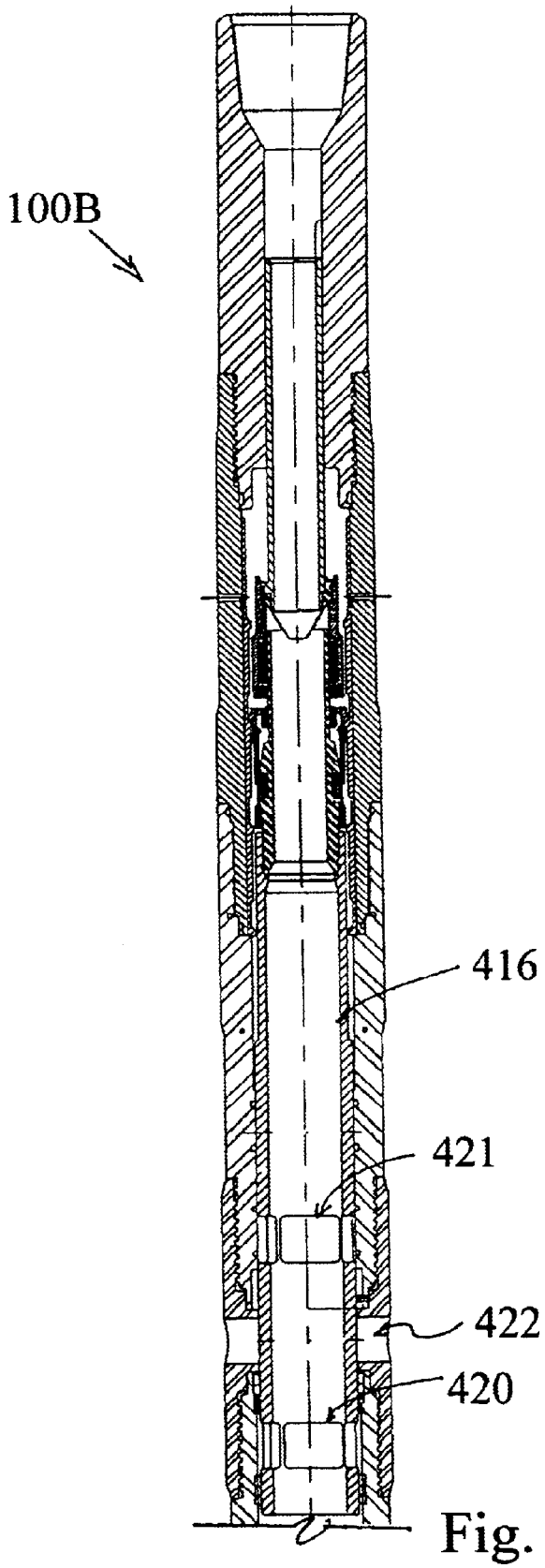
FIG. 9 is an elevation view of a second embodiment of a surge pressure reduction tool having multiple sequences of surge pressure reduction functionality in the closed port position.

With reference to FIGS. 7–9, the housing assembly 401, 402 contains a yieldable ball seat 410 connected to a camming sleeve 411. The lower end of a dart directing sleeve 412 is connected to the yieldable ball seat 410, and a snap ring 413 is utilized to secure the yieldable ball seat and dart directing sleeve in place on the upper end of the camming sleeve 411. The camming sleeve 411 is supported by spring washers 414. The spring washers 414 are in turn supported on a threaded sleeve 415 that is connected with the top of a valving sleeve 416. At least two sets of axially spaced sleeve flow ports 420, 421 are formed in the valving sleeve 416. Additionally, a set of housing flow holes 422 is formed in the lower housing 402. As explained below, the valving sleeve 416 is indexed axially downward in the operation of a diverter device 100B in accordance with the present invention. Initially, the axial position of valving sleeve 416 is such that the set of sleeve flow ports 420 is aligned with the set of housing flow holes 422. When the axial position of the valving sleeve 416 is such that a set of sleeve flow ports 420, 421 is aligned with the set of housing flow holes 422, diverter device 100B is in an "open port position" (FIG. 8). When the axial position of the valving sleeve 416 is such that no set of sleeve flow ports 420, 421 is aligned with the set of housing flow holes 422, the diverter device 100B is in a "closed port position" (FIG. 9).

With reference to FIG. 7, the apparatus in accordance with the present invention further includes an indexing mechanism to shift the diverter device 100B between the open port position and the closed port position. The indexing mechanism is contained within the upper housing 401 and has four latch positions 501, 502, 503, 504 designed to support axially downward indexing. Axially spaced internal protrusions or "rings" at positions 501, 502, 503, 504 are machined in the bore of the upper housing 401 that contains the latching mechanism. The axial spacing of these machined rings determines the specific position of the indexing mechanism at any given time. The rings are engaged by an assembly of pivoting latching fingers 430, 431. One end of each latching finger 430, 431 is attached to the threaded sleeve 415. The assembly of latching fingers comprises both long fingers 430 and short fingers 431. The short fingers 431 are evenly interspersed among the long fingers 430 such that every other finger is a short finger. Each latching finger 430, 431 includes an external shoulder that rests on the internal machined indexing rings of the housing while also including an internal protrusion that interacts with the camming sleeve 411 so that the camming sleeve alternately forces the short or long latching fingers radially outward.

Still with reference to FIG. 7, the short and long latching fingers 430, 431 are initially positioned to span across the top machined internal ring 501. The camming sleeve 411 is supported in the uppermost position by the spring washers 414 until a drop ball 450 lands in the yieldable ball seat 410. With the camming sleeve 411 in the uppermost position, the long latching fingers 430 are forced radially outward and thus the internal ring 501 of the housing restrains the indexing assembly from moving downward.

In operation, the diverter device 100B in accordance with the present invention provides for the running, hanging, and cementing of a drilling/production liner downhole in a single running.

With reference to FIGS. 1, 7, and 8, the diverter device 100B is run into a borehole BH with the camming sleeve 411 and valving sleeve 416 positioned such that the long latching fingers 430 are caught on the top face of the uppermost housing ring at latch position 501. In this position, the short fingers 431 are positioned immediately below the uppermost housing ring at latch position 501. In this "open port position," the set of sleeve flow ports 420 of valving sleeve 416 is aligned with the set of housing flow holes 422 and a flow path exists for drilling fluid to flow upward into the drilling/production liner 103 through the volume compensation device 101 and diverter device 100B, and outward to the annulus between the drill string S and surface casing C2 via aligned flow hole 422 and flow port 420.

The drilling/production liner 103 is run into the borehole with the diverter device 100B in the open port position and thus the benefits of surge pressure reduction are realized. However, if the drilling/production liner 103 encounters a tight hole condition within the borehole BH, then circulation is required to free the drilling/production liner, and the diverter device 100B must be moved to the closed port position.

With reference to FIGS. 7 and 9, the diverter device 100B in accordance with the present invention is shifted to the closed port position by releasing a first drop ball 450 down the drill string S, through the dart directing sleeve 412, and into the yieldable seat 410. The drilling fluid pressure is then increased above the drop ball 450 and the yieldable ball seat 410 to a first predetermined level, which moves the yieldable ball seat and camming sleeve 411 from its initial axial position downward against the resistance of the spring washers 414 to a second axial position. This downward axial movement frees the radial restraint on the long latching fingers 430 while simultaneously forcing the short latching fingers 431 radially outward. The inward radial motion of the long latching fingers 430 releases the indexing assembly and allows it, and the valving sleeve 416, to move axially downward. The simultaneous outward radial motion of the short latching fingers 431 provides an external protrusion that will catch the short fingers on the next lower ring at latch position 502. The downward movement of the indexing assembly and attached valving sleeve is arrested at latch position 502 and the diverter device 100B is now in the closed port position.

Still with reference to FIGS. 7 and 9, once the indexing apparatus is shifted into the closed port position, the pressure above the first drop ball 450 is increased further to a predetermined level where the yieldable ball seat 410 yields to an extent that permits the first drop ball to pass through the yieldable ball seat and on down to the bottom of the borehole. Once the first drop ball 450 passes the yieldable ball seat 410 and the pressure is freed from the spring washers 414, the spring washers reset and push the camming sleeve 411 slightly back up so that the short latching fingers 431 are free to move radially inward and the long fingers 431 are forced radially outward. The valving sleeve 416 then slips slightly downward so that the radially protruding long fingers 430 catch on the ring at latch position 502.

With reference to FIGS. 1 and 9, once the diverter device 100B is in the first closed port position and circulation is established, drilling fluid can be pumped downward along a flow path from the surface, through the drill string S, diverter device 100B, and volume compensation device 101, and to the bottom of the drilling/production liner 103 (FIG. 1) to free the drilling/production liner from the tight hole condition. Once the drilling/production liner 103 is free, downhole running operations can continue and surge pressure reduction can be reestablished by shifting the indexing apparatus into a second open port position using a second drop ball having a diameter greater than the diameter of the first drop ball. After the drilling/production liner is run to total depth, the indexing apparatus can be shifted downward into a second closed port position using a third drop ball having a diameter greater than the diameter of the second drop ball. In the second closed port position, cementing operations can be performed.

With respect to the two embodiments described above, if the passage through the drilling/production liner is obstructed by drill cuttings or downhole debris, then releasing a drop ball into the yieldable ball seat will effectively trap the drilling fluid between the yieldable ball seat and the plugged drilling/production liner. Therefore, when drilling fluid pressure is increased above the drop ball to shift the diverter device into the closed port position, the trapped drilling fluid will resist the downward shifting of the sleeve. This condition is called "hydraulic lock." In this hydraulic lock condition, the sleeve of the diverter tool can not be shifted axially downward to block the housing flow holes. With the housing flow holes unobstructed, circulation and, more significantly, critical cementing operations can not be performed. Therefore, the volume compensation device, once activated, accumulates enough of the trapped drilling fluid to permit the sleeve of the diverter device to be shifted axially downward. Once a sufficient volume of the resisting drilling fluid is removed, the hydraulic lock condition ends and the sleeve is moved to the closed port position.

With reference to FIGS. 2 and 3, in operation, the volume compensation device 101 accumulates the trapped drilling fluid to enable the sleeve of the diverter device to shift to the closed port position. As the drilling fluid pressure above the drop ball is increased, the trapped drilling fluid beneath the drop ball forces the annular piston 203 upward against the restraint of the shear pins 204. Once the force against the annular piston is sufficient to shear the shear pins 204, the volume compensation device is activated and the annular piston 203 is released from the lower end of the inner sleeve 201.

Figures 10A, 10B, 10C:
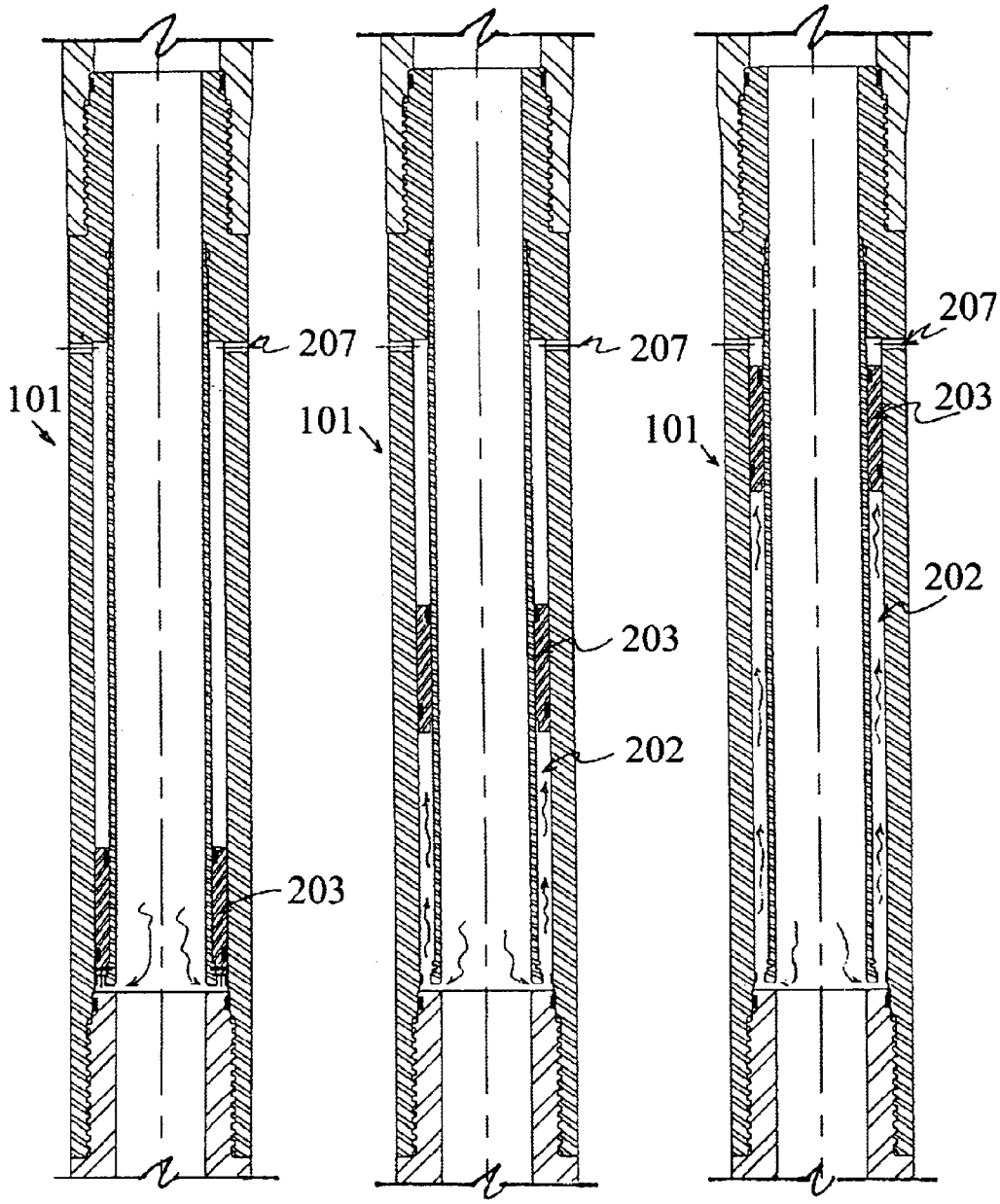
FIG. 10A is an enlarged view of a preferred embodiment of a volume compensation device in accordance with the present invention depicting an annular piston connected to an inner sleeve by a shear pin.
FIG. 10B is an enlarged view of a preferred embodiment of a volume compensation device in accordance with the present invention depicting the annular piston moving axially upward after being released from the shear pin connection with the inner sleeve.
FIG. 10C is an enlarged view of a preferred embodiment of a volume compensation device in accordance with the present invention depicting the annular piston moving axially upward and approaching fter being released from the shear pin connection with the inner sleeve.

With reference to FIGS. 10A, 10B, and 10C, once the annular piston 203 is released, the trapped drilling fluid forces the annular piston upwards. As the annular piston 203 moves upward, the drilling fluid fills the volume vacated by the rising piston. As the drilling fluid pressure above the drop ball forces the sleeve of the diverter device to move axially downward, the trapped drilling fluid reacts by forcing the annular piston 203 further upward filling in the vacated space below the piston until enough drilling fluid has been displaced to shift the sleeve into the closed port position.

Furthermore, as the annular piston 203 moves axially upward, it sweeps any fluid that has collected in the compensation volume annulus 202 outward into the borehole via a set of annulus holes 207. It is also intended that the compensation volume annulus 202 above the annular piston may be filled with a preservative compound such as grease to prevent contamination of the compensation volume annulus as the surge pressure reduction tool is run downhole.

Once the sleeve is in the closed port position and the housing flow ports are blocked, drilling fluid pressure is increased above the drop ball to push the drop ball through the yieldable seat. Now a flow path is established through the diverter device such that drilling fluid can be pumped through the drilling/production liner to remove the plugged drill cuttings or downhole debris. Finally, with the diverter device in the closed port position, circulation can be performed if the drilling/production liner is in a tight hole condition or cementing operations can be commenced if the drilling/production liner is at total depth.

In the appended claims, the term "open port position" refers to a condition where the set of flow holes formed in the housing assembly of the diverter device is not blocked by a sleeve; and the term "closed port position" refers to a condition where the set of flow holes formed in the housing assembly of the diverter device is blocked by a sleeve in the diverter device. Furthermore, the term "plugged" refers to a condition where passage through the tubular member is obstructed by drill cuttings or downhole debris

What is claimed is:

1. Apparatus for use in reducing surge pressure while running a tubular member through a borehole containing drilling fluid using a drilling rig, said apparatus comprising:

a drill pipe for communication between the drilling rig and the borehole, said drill pipe comprising an upper end operatively connected to the drilling rig and a lower end, a diverter device for directing flow of drilling fluid, said diverter device comprising: (i) a housing assembly having an upper end operatively connected to the lower end of the drill pipe and a lower end, said housing assembly having a set of flow holes formed therein; (ii) a sleeve within the housing assembly having an upper end and a lower end, said sleeve being movable between an open port position where the set of flow holes is not blocked by the sleeve and a closed port position where the set of flow holes is blocked by the sleeve; and (iii) means to shift the sleeve downward from an open port position to a closed port position, said means displacing a predetermined volume of drilling fluid to shift the sleeve downward from an open port position to a closed port position, and a volume compensation device which, when activated, accumulates a volume of drilling fluid equal to or greater than the volume of drilling fluid which is displaced when the sleeve of the diverter device is shifted downward from an open port position to a closed port position, said volume compensation device having an upper end operatively connected to the diverter device and a lower end operatively connected to the tubular member.

2. Apparatus for use in reducing surge pressure while running a tubular member through a borehole containing drilling fluid using a drilling rig, said apparatus comprising:

a drill pipe for communication between the drilling rig and the borehole, said drill pipe comprising an upper end operatively connected to the drilling rig and a lower end, a diverter device for directing flow of drilling fluid, said diverter device comprising: (i) a housing assembly having an upper end operatively connected to the lower end of the drill pipe and a lower end, said housing assembly having a set of flow holes formed therein; (ii) a sleeve within the housing assembly having an upper end and a lower end, said sleeve being movable between an open port position where the set of flow holes is not blocked by the sleeve and a closed port position where the set of flow holes is blocked by the sleeve; and (iii) means to shift the sleeve downward from an open port position to a closed port position, said means displacing a predetermined volume of drilling fluid to shift the sleeve downward from an open port position to a closed port position, and a volume compensation device which, when activated, accumulates a volume of drilling fluid equal to or greater than the volume of drilling fluid which is displaced when the sleeve of the diverter device is shifted downward from an open port position to a closed port position, said volume compensation device having an upper end operatively connected to the diverter device and a lower end operatively connected to the tubular member, wherein the volume compensation device comprises: (i) a housing with an upper end operatively connected to the lower end of the housing assembly of the diverter device, a lower end operatively connected to the tubular member, and an axial bore formed therethrough, said housing having at least one flow hole formed near the upper end to establish communication between the axial bore of the housing and the borehole; (ii) an inner sleeve positioned inside the housing with a total axial length less than the total length of the axial bore of the housing, said inner sleeve having an outer diameter smaller than the diameter of the axial bore of the housing to form an annulus between the housing and the inner sleeve; (iii) a piston having an inner diameter approximately equal to the outer diameter of the inner sleeve and an outer diameter approximately equal to the diameter of the axial bore of the housing; and (iv) means to attach the piston to the inner sleeve near the lower end of the housing.

3. The apparatus of claim 2, wherein the means to attach the piston to the inner sleeve is a set of shear pins.

4. The apparatus of claim 2, wherein the piston further comprises an inner seal to engage the inner sleeve and an outer seal to engage the axial bore of the housing.

5. The apparatus of claim 2, wherein the sleeve of the diverter device is initially in the open port position when lowered into the borehole.

6. The apparatus of claim 5, further comprising:

an upper circumferential groove formed in the housing assembly of the diverter device;

a lower circumferential groove formed in the housing assembly of the diverter device;

a plurality of latching fingers formed on the upper end of the sleeve, each of said latching fingers having a shoulder protruding radially outward for engagement with the upper circumferential groove when the sleeve is in the open port position and the lower circumferential groove when the sleeve is in the closed port position.

7. The apparatus of claim 6, further comprising:

a yieldable ball seat attached to the sleeve of the diverter device, said yieldable ball seat movable between a sealing position and a yielding position; and a ball which is dropped down the drill pipe and which seats in the yieldable ball seat.

8. The apparatus of claim 7, further comprising:

means for establishing a first pressure above the ball to release the latching fingers from engagement with the upper circumferential groove and move the sleeve downward until the latching fingers engage the lower circumferential groove thereby moving the sleeve from the open port position to the closed port position; and means for establishing a second pressure above the ball to force the ball through the yieldable ball seat.

9. The apparatus of claim 7, further comprising:

means for establishing a first pressure above the ball to release the latching fingers from engagement with the upper circumferential groove;

means for establishing a second pressure above the ball to detach the piston from the lower end of the inner sleeve of the volume compensation device and force the piston axially upward to provide volume for the sleeve of the diverter device to move downward until the latching fingers engage the lower circumferential groove thereby moving the sleeve from the open port position to the closed port position; and means for establishing a third pressure above the ball to force the ball through the yieldable ball seat.

10. The apparatus of claim 2, wherein the sleeve of the diverter device is a valving sleeve comprising two sets of flow ports formed therein at axially spaced locations, and the valving sleeve is initially in a first open port position when lowered into the borehole.

11. The apparatus of claim 10, further comprising:

a plurality of protrusions formed in the housing assembly of the diverter device at axially spaced locations;

a plurality of latching fingers having first and second ends, the first ends of said latching fingers being attached to the threaded sleeve and the second ends of said latching fingers being formed to engage the protrusions in the housing assembly, some of the latching fingers having a length which is longer than the length of the remainder of the latching fingers;

spring washers which are supported by the threaded sleeve; and a camming sleeve including a yieldable ball seat, which camming sleeve is supported by the spring washers and movable from a first axial position to a second axial position, where the camming sleeve in said first axial position contacts the second ends of the longer latching fingers to force them into engagement with one of the protrusions in the housing assembly and where the movement of the camming sleeve to the second axial position releases the longer latching fingers from engagement with the protrusion and forces the second ends of the shorter latching fingers into contact with the inside of the housing assembly.

12. The apparatus of claim 11, further comprising:

a first ball which is dropped down the drill pipe and which seats in the yieldable ball seat;

means for establishing a first pressure above the first ball which is sufficient to move the camming sleeve from its first axial position to its second axial position and to move the valving sleeve from the first open port position to a first closed port position;

means for establishing a second pressure above the first ball which is sufficient to force the first ball through the yieldable ball seat.

13. The apparatus of claim 12, further comprising:

a second ball which is dropped down the drill pipe and which seats in the yieldable ball seat, said second ball having a larger diameter than said first ball;

means for establishing a first pressure above the second ball which is sufficient to move the camming sleeve from its first axial position to its second axial position and to move the valving sleeve from the first closed port position to a second open port position; and means for establishing a second pressure above the second ball which is sufficient to force the second ball through the yieldable ball seat.

14. The apparatus of claim 13, further comprising:

a third ball which is dropped down the drill string and which seats in said yieldable ball seat, said third ball having a larger diameter than said second ball;

means for establishing a first pressure above the third ball which is sufficient to move the camming sleeve from its first axial position to its second axial position and to move the valving sleeve from the second open port position to a second closed port position; and means for establishing a second pressure above the third ball which is sufficient to force the third ball through the yieldable ball seat.

15. The apparatus of claim 13, wherein communication through the tubular member is interrupted, further comprising:

a third ball which is dropped down the drill string and which seats in said yieldable ball seat, said third ball having a larger diameter than said second ball;

means for establishing a first pressure above the third ball which is sufficient to move the camming sleeve from its first axial position to its second axial position;

means for establishing a second pressure above the third ball to release the piston from the lower end of the inner sleeve of the volume compensation device and force the piston axially upward to provide volume for the valving sleeve of the diverter device to move downward from the second open port position to a second closed port position; and means for establishing a third pressure above the third ball to force the third ball through the yieldable ball seat.

16. The apparatus of claim 11, further comprising:

a first ball which is dropped down the drill pipe and which seats in the yieldable ball seat;

means for establishing a first pressure above the first ball which is sufficient to move the camming sleeve from its first axial position to its second axial position means for establishing a second pressure above the first ball to release the piston from the lower end of the inner sleeve of the volume compensation device and force the piston axially upward to provide volume for the valving sleeve of the diverter device to move downward from the first open port position to a first closed port position; and means for establishing a third pressure above the first ball to force the first ball through the yieldable ball seat.

17. A method for reducing surge pressure while running in a tubular member on a drill pipe with a running tool through a borehole containing drilling fluid using a drilling rig, comprising:

providing a diverter tool between the drill pipe and the tubular member which establishes a flow path for drilling fluid to flow upward from the borehole into the tubular member, from the tubular member to the running tool, from the running tool to the diverter tool, and from the diverter tool into an annulus between the drill pipe and the borehole;

shifting the diverter tool to alter the flow path for drilling fluid to flow downward from the drilling rig to the drill pipe, from the drill pipe to the diverter tool, from the diverter tool to the running tool, from the running tool to the tubular member, and from the tubular member into the borehole; said shifting step displacing a predetermined volume of drilling fluid; and providing a device between the diverter tool and the running tool which device, when activated, accumulates a volume of drilling fluid equal to or greater than the volume of drilling fluid which is displaced by the shifting step.

18. A method for reducing surge pressure while running in a tubular member on a drill pipe through a borehole containing drilling fluid using a drilling rig, comprising:

operatively connecting a diverter device between the drill pipe and the tubular member, said diverter device including (i) a housing assembly with a set of flow holes formed therein, (ii) a sleeve that can be moved between an open port position where the set of flow holes is not blocked by the sleeve and a closed port position where the set of flow holes is blocked by the sleeve, and (iii) means for shifting the sleeve downward from an open port position to a closed port position displacing a predetermined volume of drilling fluid; and operatively connecting a volume compensation device between the diverter device and the tubular member, said volume compensation device providing a volume to the diverter device equal to or greater than the volume used to shift the sleeve downward from an open port position to a closed port position.

19. A method for reducing surge pressure while running in a tubular member on a drill pipe through a borehole containing drilling fluid using a drilling rig, comprising:

operatively connecting a diverter device between the drill pipe and the tubular member, said diverter device including (i) a housing assembly with a set of flow holes formed therein, (ii) a sleeve that can be moved between an open port position where the set of flow holes is not blocked by the sleeve and a closed port position where the set of flow holes is blocked by the sleeve, and (iii) means for shifting the sleeve downward front an open port position to a closed port position displacing a predetermined volume of drilling fluid; and operatively connecting a volume compensation device between the diverter device and the tubular member, said volume compensation device providing a volume to the diverter device equal to or greater than the volume used to shift the sleeve downward from an open port position to a closed port position, wherein the means for shifting the sleeve includes a yieldable ball seat attached to the sleeve and the volume compensation device includes: (i) a housing having an upper end, a lower end, and at least one flow port formed near the upper end; (ii) an inner sleeve within the housing having an upper end and a lower end and forming an annulus between the housing and the inner sleeve; and (iii) a piston arranged within the annulus and initially attached to the lower end of the inner sleeve by a set of shear pins.

20. The method of claim 19, further comprising the steps of:

lowering the tubular member into the borehole with the sleeve of the diverter device initially in the open port position; and moving the sleeve of the diverter device downward from the initial open port position to the closed port position.

21. The method of claim 20 wherein the step of lowering the tubular member into the borehole with the sleeve in the open port position further comprises:

providing a flow path for drilling fluid to flow upward into the tubular member, through the volume compensation device and the diverter device, and outward into an annulus between the drill pipe and the borehole via the set of flow holes.

22. The method of claim 20 wherein the step of moving the sleeve of the diverter device downward to the closed port position further comprises:

providing a flow path for drilling fluid to flow downward through the drill pipe, past the diverter device and the volume compensation device, and outward into the borehole via the tubular member.

23. The method of claim 20, wherein the step of moving the sleeve downward comprises the steps of:

dropping a ball into the yieldable ball seat, said ball sealing with the yieldable ball seat;

increasing drilling fluid pressure to a first predetermined level above the ball and against the sleeve to move the sleeve axially downward from the open port position to the closed port position; and further increasing drilling fluid pressure to a second predetermined level above the ball to expand the yieldable ball seat to allow the ball to pass through the yieldable ball seat.

24. The method of claim 20, wherein the step of moving the sleeve downward comprises the steps of:

dropping a ball into the yieldable ball seat, said ball sealing with the yieldable ball seat;

increasing drilling fluid pressure to a first predetermined level above the ball to detach the piston from the lower end of the inner sleeve of the volume compensation device and force the piston axially upward to provide volume for the sleeve of the diverter device to move downward from the open port position to the closed port position; and further increasing drilling fluid pressure to a second predetermined level above the ball to expand the yieldable ball seat to allow the ball to pass through the yieldable ball seat.

25. A method for reducing surge pressure while running in a tubular member on a drill pipe through a borehole containing drilling fluid using a drilling rig, comprising:

operatively connecting a diverter device between the drill pipe and the tubular member, said diverter device including (i) a housing assembly with a set of flow holes formed therein, (ii) a sleeve that can be moved between an open port position where the set of flow holes is not blocked by the sleeve and a closed port position where the set of flow holes is blocked by the sleeve, and (iii) means for shifting the sleeve downward from an open port position to a closed port position displacing a predetermined volume of drilling fluid; and operatively connecting a volume compensation device between the diverter device and the tubular member, said volume compensation device providing a volume to the diverter device equal to or greater than the volume used to shift the sleeve downward from an open port position to a closed port position, wherein the sleeve of the diverted device is a valving sleeve having an upper end, a lower end, and two sets of flow ports formed therein at axially spaced locations, said valving sleeve initially being in a first open port position.

26. The method of claim 25, wherein the diverter device includes: (i) a plurality of protrusions formed in the housing assembly at axially spaced locations; (ii) a threaded sleeve operatively connected to the upper end of the valving sleeve; (iii) a plurality of latching fingers having first and second ends, the first ends of said latching fingers being attached to the threaded sleeve and the second ends of said latching fingers being formed to engage the protrusions in the housing assembly, some of the latching fingers having a length which is longer than the length of the remainder of the latching fingers; (iv) spring washers which are supported by the threaded sleeve; and (v) a camming sleeve including a yieldable ball seat, which camming sleeve is supported by the spring washers and movable from a first axial position to a second axial position, where the camming sleeve in said first axial position contacts the second ends of the longer latching fingers to force them into engagement with one of the protrusions in the housing assembly and where the movement of the camming sleeve to the second axial position releases the longer latching fingers from engagement with the protrusion and forces the second ends of the shorter latching fingers into contact with the inside of the housing assembly.

27. The method of claim 26, wherein the volume compensation device includes: (i) a housing having an upper end, a lower end, and at least one flow port formed near the upper end; (ii) an inner sleeve within the housing having an upper end and a lower end and forming an annulus between the housing and the inner sleeve; and (iii) a piston arranged within the annulus and initially attached to the lower end of the inner sleeve by a set of shear pins.

28. The method of claim 27, further comprising the steps of:

lowering the tubular member into the borehole with the valving sleeve in the first open port position;

moving the valving sleeve of the diverter device downward from the first open port position to a first closed port position;

moving the valving sleeve of the diverter device downward from the first closed port position to a second open port position; and moving the valving sleeve of the diverter device downward from the second open port position to a second closed port position.

29. The method of claim 28, wherein the step of moving the valving sleeve downward further comprises the steps of:

dropping a first ball into the yieldable ball seat, said first ball sealing with the yieldable ball seat;

increasing drilling fluid pressure to a first predetermined level above the first ball to move the camming sleeve from its first axial position to its second axial position and to move the valving sleeve from the first open port position to the first closed port position; and increasing drilling fluid pressure to a second predetermined level above the first ball to expand the yieldable ball seat to allow the first ball to pass through the yieldable ball seat.

30. The method of claim 29, further comprising the steps of:

dropping a second ball into the yieldable ball seat, said second ball sealing with the yieldable ball seat;

increasing drilling fluid pressure to a first predetermined level above the second ball to move the camming sleeve from its first axial position to its second axial position and to move the valving sleeve from the first closed port position to the second open port position; and increasing drilling fluid pressure to a second predetermined level above the second ball to expand the yieldable ball seat to allow the second ball to pass through the yieldable ball seat.

31. The method of claim 30, further comprising the steps of:

dropping a third ball into the yieldable ball seat, said ball sealing with the yieldable ball seat;

increasing drilling fluid pressure to a first predetermined level above the third ball to move the camming sleeve from its first axial position to its second axial position and to move the valving sleeve from the second open port position to the second closed port position; and increasing drilling fluid pressure to a second predetermined level above the third ball to expand the yieldable ball seat to allow the third ball to pass through the yieldable ball seat.

32. The method of claim 30, wherein the step of moving the valving sleeve downward comprises the steps of:

dropping a third ball into the yieldable ball seat, said third ball sealing with the yieldable ball seat;

increasing drilling fluid pressure to a first predetermined level above the third ball to move the camming sleeve from its first axial position to its second axial position and to detach the piston from the lower end of the inner sleeve of the volume compensation device and force the piston axially upward to provide volume for the sleeve of the diverter device to move downward from the second open port position to the second closed port position; and further increasing drilling fluid pressure to a second predetermined level above the third ball to expand the yieldable ball seat to allow the third ball to pass through the yieldable ball seat.

33. The method of claim 28, wherein the step of moving the valving sleeve downward comprises the steps of:

dropping a first ball into the yieldable ball seat, said first ball sealing with the yieldable ball seat;

increasing drilling fluid pressure to a first predetermined level above the first ball to move the camming sleeve from its first axial position to its second axial position and to detach the piston from the lower end of the inner sleeve of the volume compensation device and force the piston axially upward to provide volume for the sleeve of the diverter device to move downward from the first open port position to the first closed port position; and further increasing drilling fluid pressure to a second predetermined level above the first ball to expand the yieldable ball seat to allow the first ball to pass through the yieldable ball seat.

34. The method of claim 28 wherein the step of lowering the tubular member into the borehole with sleeve in the open port position and the step of moving the diverter device to the second open port position each comprises the step of:

providing a flow path for drilling fluid to flow upward into the tubular member, through the volume compensation device and the diverter device, and outward into an annulus between the drill pipe and the borehole via the set of flow holes.

35. The method of claim 28 wherein the step of moving the surge pressure reduction device to the first closed port position and the step of moving the diverter device to the second closed port position each comprises the step of:

providing a flow path for drilling fluid to flow downward through the drill pipe, through the diverter device and the volume compensation device, and outward into the borehole via the tubular member.

* * * * *